US009739141B2

(12) United States Patent
Zeng et al.

(10) Patent No.: US 9,739,141 B2
(45) Date of Patent: Aug. 22, 2017

(54) DATA TRANSMISSION SYSTEM AND METHOD FOR TRANSMISSION OF DOWNHOLE MEASUREMENT-WHILE-DRILLING DATA TO GROUND

(71) Applicants: CHINA PETROLEUM & CHEMICAL CORPORATION, Beijing (CN); SINOPEC RESEARCH INST. OF PETROLEUM ENGINEERING, Beijing (CN)

(72) Inventors: Yijin Zeng, Beijing (CN); Wei Zhang, Beijing (CN); Jibo Li, Beijing (CN); Weining Ni, Beijing (CN); Huangsheng Lu, Beijing (CN); Sanguo Li, Beijing (CN); Dawei Deng, Beijing (CN); Zuyang Zhu, Beijing (CN); Yiting Zheng, Beijing (CN); Xin Li, Beijing (CN); Yongjie Li, Beijing (CN)

(73) Assignees: CHINA PETROLEUM & CHEMICAL CORPORATION, Beijing (CN); SINOPEC RESEARCH INSTITUTE OF PETROLEUM ENGINEERING, Beijing (CN)

( * ) Notice: Subject to any disclaimer, the term of this patent is extended or adjusted under 35 U.S.C. 154(b) by 11 days.

(21) Appl. No.: 14/892,842

(22) PCT Filed: May 22, 2014

(86) PCT No.: PCT/CN2014/078170

§ 371 (c)(1),
(2) Date: Nov. 20, 2015

(87) PCT Pub. No.: WO2014/187346

PCT Pub. Date: Nov. 27, 2014

(65) Prior Publication Data

US 2016/0115783 A1 Apr. 28, 2016

(30) Foreign Application Priority Data

May 22, 2013 (CN) ..... 2013 1 0191269
May 22, 2013 (CN) ..... 2013 1 0193918

(51) Int. Cl.
*G08B 13/08* (2006.01)
*E21B 47/12* (2012.01)

(52) U.S. Cl.
CPC ..... *E21B 47/122* (2013.01); *E21B 47/124* (2013.01)

(58) Field of Classification Search
CPC ..... E21B 47/122; E21B 47/124
See application file for complete search history.

(56) References Cited

U.S. PATENT DOCUMENTS 5,679,894 A 10/1997 Kruger et al.
5,991,602 A 11/1999 Sturm
(Continued)

FOREIGN PATENT DOCUMENTS

CN 1305564 A 7/2001
CN 201705343 U 1/2011
(Continued)

OTHER PUBLICATIONS

Liu et al., "Study on Information and Power Transmission Based on an Intelligent Drilling String," Petroleum Drilling Techniques, Sep. 2006, vol. 34, No. 5, pp. 10-13, with an English language abstract.
(Continued)

*Primary Examiner* — Brian Zimmerman
*Assistant Examiner* — Thomas McCormack
(74) *Attorney, Agent, or Firm* — Buchanan Ingersoll & Rooney PC

(57) ABSTRACT

Disclosed is a data transmission system and a method for transmission of downhole measurement data to the ground.
(Continued)

The system includes a drill string mounted with a logging while drilling measurement tool, and a throw while drilling section, which accommodates a micromemory. The throw while drilling section includes a housing which is mounted outside of the drill string as a sleeve to form a clearance space therebetween; a control circuit; and a wireless transceiver. The throw while drilling section releases, under function of a micromemory release instruction transmitted by the control circuit, the micromemory loaded with the downhole measurement data to the ground.

15 Claims, 5 Drawing Sheets

(56) References Cited

U.S. PATENT DOCUMENTS

| | | | | |
|---|---|---|---|---|
| 6,241,028 | B1 | 6/2001 | Bijleveld et al. | |
| 6,411,195 | B1 * | 6/2002 | Goldman | G07C 9/00182 340/407.1 |
| 6,443,228 | B1 * | 9/2002 | Aronstam | E21B 47/12 166/250.11 |
| 6,554,065 | B2 | 4/2003 | Fisher et al. | |
| 6,912,177 | B2 | 6/2005 | Smith | |
| 9,250,339 | B2 * | 2/2016 | Ramirez | G01V 1/32 |
| 2008/0007421 | A1 * | 1/2008 | Liu | G01V 11/002 340/853.3 |
| 2010/0066497 | A1 * | 3/2010 | Lim | G06Q 10/08 340/10.1 |
| 2012/0132418 | A1 * | 5/2012 | McClung, III | B82Y 15/00 166/250.12 |

FOREIGN PATENT DOCUMENTS

| | | | |
|---|---|---|---|
| CN | 102251769 | A | 11/2011 |
| EP | 0550521 | B1 | 8/1995 |
| EP | 0848512 | A2 | 6/1998 |
| EP | 1584783 | B1 | 8/2007 |
| WO | WO 92/06278 | A1 | 4/1992 |
| WO | WO 0073625 | A1 | 12/2000 |

OTHER PUBLICATIONS

Yang et al., "New Data Transmission Technologies of Well Logging While Drilling," Petroleum Instruments, Dec. 2004, vol. 18, No. 6, pp. 26-31, with an English language abstract.

Kiao et al., "Status Quo and Prospects of Rotary Steerable Drilling Technology", China Petroleum Machinery, 2006, vol. 34, No. 4, pp. 66-70.

Du et al., "Application of a Voice Wave Delivering Testing Technology in the System of Oil Field", Measurement & Control Technology, 2005, vol. 24, No. 11, pp. 76-78, with an English language abstract.

International Search Report (PCT/ISA/210) mailed on Aug. 19, 2014, by the State Intellectual Property Office of China as the International Searching Authority for International Application No. PCT/CN2014/078170.

* cited by examiner

DATA TRANSMISSION SYSTEM AND METHOD FOR TRANSMISSION OF DOWNHOLE MEASUREMENT-WHILE-DRILLING DATA TO GROUND

FIELD OF THE INVENTION

The present disclosure relates to the field of oil and gas development and exploration, and in particular, to a data transmission system and a method for transmission of downhole measurement while drilling data to the ground.

BACKGROUND OF THE INVENTION

With rapid growth of offshore drilling and constant development of horizontal well technology, a logging while drilling (LWD) technology has been increasingly used in a widespread manner. The LWD technology is distinguished from conventional wireline logging substantially by real-time data acquisition. That is, formation data can be acquired without invasion or with merely slight invasion of a drilling fluid, and therefore can reflect the conditions of undisturbed zone more accurately. Formation data are tested and transmitted to the ground for on-site analysis and interpretation during well drilling. This not only shortens a drilling cycle, but also provides guidance of well drilling, adjustment of drilling trajectories, and improvement of drilling procedures. Therefore, how to manage signal transmission from a bottom hole to the ground is both an essential step in the LWD technology and one of the bottlenecks restricting development thereof.

Currently, a real-time transmission mode and a storage transmission mode are used to achieve signal transmission from the bottom hole to the ground. According to the real-time transmission mode, various wired or wireless transmission approaches can be employed to transmit measurement while drilling (MWD) data to the ground in time. The real-time transmission mode is of paramount importance to guidance of well drilling, especially to geosteering during well drilling. At present, however, there are hardly any data transmission approaches that can satisfy the requirements for prompt and effective transmission of large amounts of data from the bottom hole to the ground. The storage transmission mode means that LWD data are directly stored in a measuring tool, and then read out with a cable when an MWD instrument is lifted to the ground at trip out. This mode, although can be used to accomplish collection of large amounts of data, cannot meet the real-time requirement.

Wired transmission approaches include cable transmission, optical fiber transmission, and drill shaft transmission ones. Document 1 ("Researches on Intelligent Drillstring Information and Power Transmission System," *Petroleum Drilling Techniques,* 2006, 34(5), pp 10-13) discloses an approach of signal transmission through cables while drilling, comprising putting an armored cable down into a drill shaft, followed by signal transmission. However, as the drilling depth increases, the cable and an MWD instrument have to be lifted to the ground when an additional cable is necessary, or alternatively, such an additional cable has to be inserted into inner bores of the drill shaft in advance. Document 2 ("New Technology of MWD Data Transmission," *Petroleum Instruments,* 2004, 18(6), pp 26-31) discloses an approach of optical fiber transmission, comprising putting an optical fiber having a protective layer down into a well, and connecting the optical fiber to the ground via an MWD instrument placed at the bottom hole, such that MWD data can be transmitted via the optical fiber. Since the optical fiber and the cable have the same functions, they bring about the same problems also. Document 3 ("Status Quo and Prospects of Rotary Steerable Drilling Technology," *China Petroleum Machinery,* 2006, 34(4), pp 66-70) discloses an approach of drill shaft transmission, comprising mounting a conductor into a drill shaft, and allowing the conductor to become a part of an integral drill shaft, wherein a special connection module mounted on a drill shaft joint enables an entire drill string to form an electrical signal passage, thus achieving data transmission.

The above approaches, due to adoption of wired connection, have the advantage of rather fast transmission rates, much faster than those of wireless approaches. However, the cable, the optical fiber, and the special drill shaft connector have to be mounted to a whole wellbore. During well drilling, the drill shaft rotating at a speed will render these wired media easily damaged. As can be seen, these prior arts have the same defects as inferior reliability, relatively complex manufacturing procedures, and frequent interference with normal drilling procedures. As a result, the above techniques are not quite commonly used in practical manufacturing procedures through the LWD technology.

Wireless transmission approaches include use of mud (drilling fluid) pulse, electromagnetic wave, and acoustic wave approaches, among which the mud pulse and electromagnetic wave approaches have been used in practical LWD production, and the mud pulse approach is most widely used. Chinese patent application 201020298582.3, entitled "High-speed transmission sending device for measurement while drilling," discloses a mud pulse signal generator, mainly comprising a discharge valve or a throttle valve, wherein when the valve is in an open or closed state, variation of flow rates of a drilling fluid flowing to an annular space in a drill string will cause drilling fluid pressure waves in the drill shaft to generate a series of pulses, and data can thus be transmitted to the ground by being loaded to these pulses via opening and closing of the valve. However, mud waves, being mechanical waves, have largely restricted speeds due to a modulation mode thereof. The highest transmission speed that has been reported so far reaches merely dozens of bits of data per second, which can hardly satisfy the requirements for fast transmission of data from the bottom hole to the ground. CN 102251769A, entitled "Electromagnetic wave signal transmission method and system of measurement while drilling," discloses an electromagnetic wave measurement while drilling method with formation as a transmission medium or with a drill string as a transmission conductor. Specifically, tested data are modulated onto an electromagnetic wave by a downhole instrument, emitted by an electromagnetic emitter from downhole, and then transmitted to the ground via various passages. Subsequently, a ground detector will detect electromagnetic signals modulated with the tested data, and a processing circuit will be used to demodulate the tested data contained in the electromagnetic signals. Document 4 ("Application of Acoustic Transmission Testing Technology in Oil Field," *Measurement & Control Technology,* 2005, 24(11), pp 76-78) discloses use of acoustic waves or seismic waves for signal transmission via a drill shaft or formation. Specifically, an acoustic emission system mounted on a drill shaft modulates various tested data onto acoustic vibration signals, which will be transmitted to the ground along the drill shaft, and received by an acoustic receiving system arranged on the ground, followed by demodulation of the tested data from the acoustic vibration signals. Like electromagnetic transmission, in acoustic transmission, no slurry circulation is necessary, and therefore it is easy to achieve acoustic transmission at low costs. However, acoustic transmission is subject to the defects of fast attenuation, and susceptibility to environment, such as interferences of low intensity signals from the wellbore, and acoustic waves and electromagnetic waves from drilling devices, thus leading to difficult signal detection and low transmission speed thereof.

Therefore, there is an urgent need of a data transmission solution to the above problems, which can achieve fast transmission of the downhole MWD data to the ground at low costs.

SUMMARY OF THE INVENTION

One of the technical problems to be solved by the present disclosure is to provide a low-cost data transmission system for fast transmission of downhole measurement while drilling data to the ground.

In order to solve the above technical problem, the present disclosure provides a data transmission system for transmission of downhole measurement while drilling data to ground, comprising a drill string mounted with a logging while drilling measurement tool, and a throw while drilling section, which is provided on the drill string and accommodates a micromemory. The throw while drilling section includes a housing which is mounted outside of the drill string as a sleeve to form a clearance space therebetween; a control circuit provided in the clearance space, used for receiving and transmitting downhole measurement data measured by the logging while drilling measurement tool; and a wireless transceiver connected to the control circuit, used for writing the downhole measurement data received by the control circuit into the micromemory. The throw while drilling section, under function of a micromemory release instruction transmitted by the control circuit, releases the micromemory loaded with the downhole measurement data to the ground.

In one embodiment, the housing of the throw while drilling section is provided with a micromemory release hole on a side wall thereof, and the micromemory loaded with the downhole measurement data is, via the micromemory release hole, released into an annular space formed between the drill string and a borehole wall, so that the micromemory can be returned to the ground along with circulation of slurry.

In one embodiment, the throw while drilling section further comprises: a power mechanism which is connected to the control circuit and controlled under function of the micromemory release instruction transmitted by the control circuit; and a micromemory release mechanism, which can, at a first state thereof, hold the micromemory, and turn to a second state under effect of the power mechanism, so that the micromemory loaded with the downhole measurement data can be released into the annular space via the micromemory release hole.

In one embodiment, the micromemory release mechanism comprises a micromemory temporary storage, which, at the first state of the micromemory release mechanism, can temporarily store the micromemory loaded with the downhole measurement data, and at the second state of the micromemory release mechanism, will rotate under action of the power mechanism, so as to communicate with the micromemory release hole.

In one embodiment, the throw while drilling section further comprises a micromemory storage tank arranged in the clearance space, the micromemory storage tank having an upper end communicating with the drill string, and a lower end communicating with the micromemory temporary storage, so that the micromemory accommodated in the micromemory storage tank can enter the micromemory temporary storage under action of a drilling fluid from the drill string.

In one embodiment, the wireless transceiver comprises a measurement while drilling data-writing data line connected to the control circuit, and a measurement while drilling data-writing antenna connected to the measurement while drilling data-writing data line and arranged in the micromemory storage tank. The measurement while drilling data-writing antenna is configured in such a manner that the downhole measurement data are written into only one micromemory stored in the micromemory storage tank each time.

In one embodiment, the measurement while drilling data-writing antenna is arranged in the micromemory storage tank at a region adjacent to the micromemory temporary storage.

In one embodiment, the power mechanism comprises a motor and a reducer.

In one embodiment, the micromemory release mechanism further comprises a drilling fluid flow passage, which is configured to communicate with the micromemory storage tank at the second state thereof only, so that the drilling fluid flowing therethrough can enter the micromemory temporary storage, and release the micromemory stored therein.

In one embodiment, the drilling fluid flow passage is formed as a flow pipe having a branch, which communicates with the micromemory temporary storage.

In one embodiment, the micromemory release mechanism turns from the first state to the second state through a 90 degree rotation.

In one embodiment, the control circuit transmits micromemory release instructions periodically.

In one embodiment, the throw while drilling section further comprises a signal receiving antenna connected to the control circuit, the signal receiving antenna receiving micromemory release instructions from the ground, and transmitting the micromemory release instructions to the control circuit.

In one embodiment, the signal receiving antenna is in the form of an RFID tag antenna, which receives micromemory release instructions in RFID tags from the ground.

In one embodiment, a ground receiving device is further included, which receives and processes the downhole measurement data stored in the micromemory.

In one embodiment, the micromemory is formed into a sphere or a cylinder having a diameter in the range from 5 to 50 mm, and a thickness in the range from 0.1 to 50 mm.

In one embodiment, the micromemory can load an amount of data in the range from 1 bit to 100 megabits.

According to another aspect of the present disclosure, a method for transmitting downhole measurement data with the above system is further provided, comprising: putting a plurality of micromemories into the throw while drilling section; receiving and transmitting, via the control circuit, the downhole measurement data measured by the logging while drilling measurement tool; writing, by the wireless transceiver, the downhole measurement data of the control circuit into the micromemories; and releasing, by the throw while drilling section, the micromemories loaded with the downhole measurement data to the ground, under function of the micromemory release instructions transmitted by the control circuit.

According to still another aspect of the present disclosure, a data transmission system for transmission of downhole measurement while drilling data to ground is further provided, comprising: a drill string mounted with a logging while drilling measurement tool; a housing which is mounted outside of the drill string as a sleeve to form a clearance space therebetween; a control circuit provided in the clearance space, used for receiving and transmitting downhole measurement data measured by the logging while drilling measurement tool; and a wireless transceiver electrically connected to the control circuit, used for writing the downhole measurement data received by the control circuit into the micromemory which passes by the wireless transceiver, wherein the micromemory loaded with the downhole measurement data is configured to be capable of, under action of a drilling fluid in the drill string, passing through a water hole of a drill connected to the drill string, and being released to the ground.

In one embodiment, a ground throwing device is further included, which is used to throw the micromemory from the ground into the drill string.

In one embodiment, the micromemory is further loaded with a ground control instruction, which can be transmitted to the control circuit by the wireless transceiver when the micromemory loaded with the ground control instruction passes by the wireless transceiver.

In one embodiment, the micromemory is formed into a sphere or a cylinder having a diameter in the range from 5 to 20 mm, and a thickness in the range from 0.1 to 20 mm.

In one embodiment, the micromemory can load an amount of data in the range from 1 bit to 100 megabits.

According to a further aspect of the present disclosure, a method for transmitting downhole measurement data with the above data transmission system is further provided, comprising: receiving and transmitting, via the control circuit, the downhole measurement data measured by the logging while drilling measurement tool; putting a plurality of micromemories into the drill string; and writing, by the wireless transceiver, the downhole measurement data received by the control circuit, into the micromemories which pass by the wireless transceiver, so that the micromemories loaded with the downhole measurement data can, under the action of the drilling fluid in the drill string, pass through the water hole of the drill connected to the drill string and be released to the ground.

Compared with the prior art, one or more embodiments of the present disclosure has the following advantages.

According to the data transmission system for transmission of downhole measurement while drilling data to the ground of the present disclosure, the throw while drilling section connected to the logging while drilling measurement tool is used to provide the micromemory loaded with the downhole measurement data to the ground, so as to transmit the downhole measure data to the ground. Through such a data transmission system, data transmission rates and communication reliability can be significantly improved. Moreover, since only slurry is used as a transmission medium of the micromemory, no additional costs will be incurred, nor will the normal drilling operation be affected.

Other features and advantages of the present disclosure will be further explained in the following description, and partly become self-evident therefrom, or be understood through implementation of the present disclosure. The objectives and advantages of the present disclosure will be achieved through the structure specifically pointed out in the description, claims, and the accompanying drawings.

BRIEF DESCRIPTION OF THE DRAWINGS

The drawings are provided for further understanding of the present disclosure, and constitute one part of the description. They serve to explain the present disclosure in conjunction with the embodiments, rather than to limit the present disclosure in any manner. In the drawings.

Figure 1:
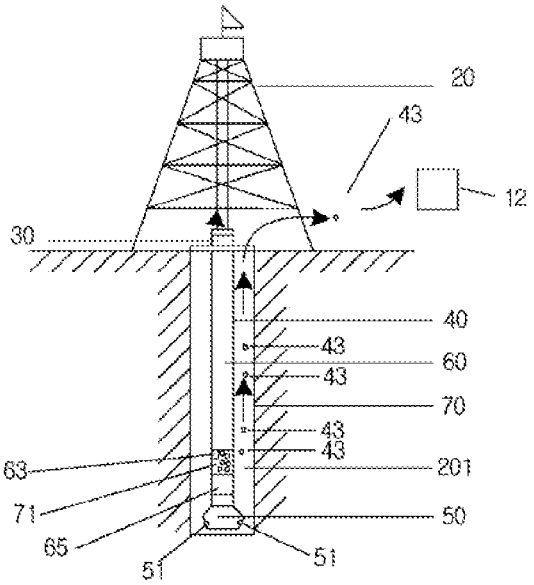
FIG. 1 schematically shows a data transmission system used for transmitting downhole measurement while drilling data to the ground according to an embodiment of the present disclosure.

In the drawings, the same components are indicated with the same reference signs. The figures are not drawn in accordance with an actual scale.

DETAILED DESCRIPTION OF THE EMBODIMENTS

In order to present the purpose, technical solution, and advantages of the present disclosure more explicitly, the present disclosure will be further explained in detail in connection with the accompanying drawings. It should be noted that spatial references in the present disclosure, such as "upper" and "lower," indicate respective directions relative to the accompanying drawings only. Hence, they are for illustrative purposes only and are not intended to be limiting of the claimed disclosure.

Embodiment 1

FIG. 1 schematically shows a data transmission system used for transmitting downhole measurement while drilling data to the ground according to an embodiment of the present disclosure.

As shown in FIG. 1, the data transmission system comprises a drill string 40, which is connected to a drilling derrick 20 set up on the ground, and mounted with a logging while drilling measurement tool 65; and a throw while drilling section 71, which is mounted on the drill string 40 and accommodating a micromemory 43. The drill string 40 includes a longitudinal fluid passage 60, which is, through an outlet thereof, communicating with a water hole 51 of a drill 50. A drilling fluid flows through the longitudinal fluid passage 60, and is used for lubricating the drill 50 and flushing drilling debris from the water hole 51. And an annular space 201 is formed between the drill string 40 and a borehole wall 70.

During a drilling operation, the drilling derrick 20 set up on the ground and a drilling rig 30 arranged at one end of the drill string 40 adjacent to the ground can be used to drive the drill string 40 to rotate at a high speed, such that the drill string 40 can drive the drill 50 to drill underground at a high speed, and thus a borehole will be drilled in the formation. Subsequently, the drill 50 will cut into different geological structural layers underground, different geological information of which will be measured by the logging while drilling measurement tool 65 arranged adjacent to the drill 51. Finally, a wireless transceiver 63 arranged in the throw while drilling section 71 will write downhole measurement data as acquired into the micromemory 43. The micromemory 43 loaded with the downhole measurement data will then be released into the ground through the throw while drilling section 71.

Figure 2:
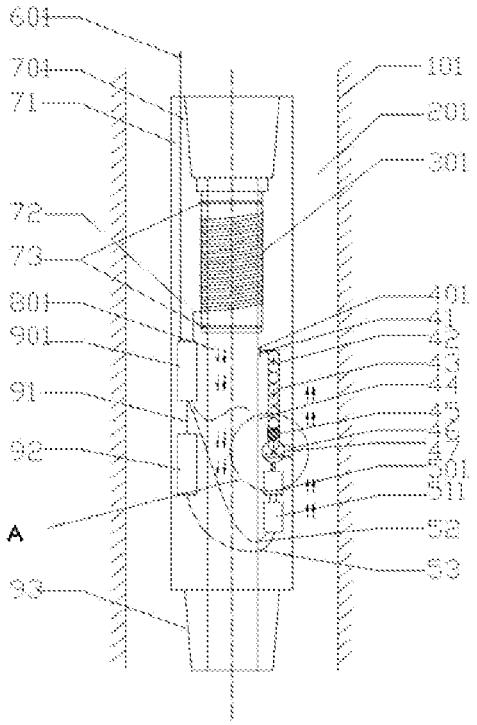
FIG. 2 schematically shows the structure of a throw while drilling section according to an embodiment of the present disclosure.

FIG. 2 schematically shows the structure of the throw while drilling section 71 according to an embodiment of the present disclosure.

As shown in FIG. 2, the throw while drilling section 71 comprises: a housing which is mounted outside of the drill string 40 as a sleeve to form a clearance space therebetween; a control circuit 901 arranged in the clearance space, used for receiving and transmitting the downhole measurement data measured by the logging while drilling measurement tool 65; and a wireless transceiver connected to the control circuit 90, used for writing the downhole measurement data received by the control circuit 901 into the micromemory. The throw while drilling section 71 will, under the action of a micromemory release instruction transmitted by the control circuit 901, release the micromemory loaded with the downhole measurement data to the ground.

In the embodiment as shown in FIG. 2, the housing as aforementioned is mounted on the drill string 40 in a fixed manner via a drill collar female fastener 701 and a drill collar male fastener 93. A side wall of the housing is provided with a micromemory release hole 46, through which the micromemory loaded with the downhole measurement data can be released into the annular space 201 formed between the drill string 40 and borehole wall 70 (formation 101), so that the micromemory can be returned to the ground along with circulation of slurry. And the control circuit 901 will, via an LWD data line 601, receive the downhole measurement data measured by the logging while drilling measurement tool 65.

In addition, the throw while drilling section 71 can further comprise a power mechanism and a micromemory release mechanism 47. The power mechanism is connected to the control circuit 901, and controlled under a micromemory release instruction transmitted by the control circuit 901. And the micromemory release mechanism 47 can, at a first state thereof, hold the micromemory (see FIG. 4), and convert to a second state under the action of the power mechanism, such that the micromemory loaded with the downhole measurement data can be released into the annular space 201 via the micromemory release hole 46 (see FIG. 5 or FIG. 6).

Figure 3:
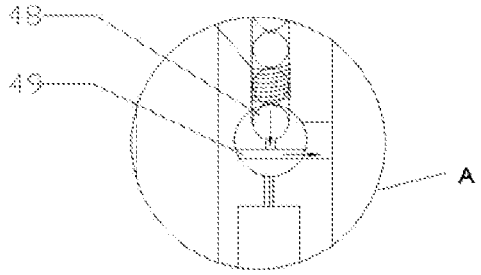
FIG. 3 schematically shows a detail view of region A as indicated in FIG. 2.

In order to further explain the micromemory release mechanism 47, reference can be made to FIG. 3. As indicated in FIG. 3, the micromemory release mechanism 47 comprises a micromemory temporary storage 48, which can, in the first state of the micromemory release mechanism 47, temporarily store the micromemory loaded with the downhole measurement data, and in the second state of the micromemory release mechanism 47, rotate to communicate with the micromemory release hole 46 under the action of the power mechanism (see FIG. 5 or FIG. 6).

The throw while drilling section 71 further comprises a micromemory storage tank 42, which is arranged in the clearance space, and has an upper end communicating with the drill string 40, and a lower end communicating with the micromemory temporary storage 48, such that the micromemory accommodated in the micromemory storage tank 42 can enter the micromemory temporary storage 48 under the action of a drilling fluid 801 from the drill string 40. In one embodiment, a filter 401 and a capillary drainage tube 41 are provided between the micromemory storage tank 42 and the drill string 40 for circulation of the drilling fluid 801. The filter 401 can remove impurities from the drilling fluid 801 through filtration, such that the drilling fluid flowing through the micromemory storage tank 42 will not damage the micromemory.

The micromemory 43 comprising a transceiver circuit, a memory circuit, and other subsidiary bodies can be formed rather small, because it will not exit from the water hole 51. Preferably, the micromemory 43 can be formed into a sphere or a cylinder having a diameter in the range from 5 to 50 mm, and a thickness in the range from 0.1 to 50 mm. And the micromemory 43 can load an amount of data in the range from 1 bit to 100 megabits.

The micromemory 43 of the present embodiment is designed to be a sphere having a diameter of only 1.2 cm and a thickness of only 0.2 cm. Thus, 1,000 such spheres will have a total volume of only 226 $cm^3$, and therefore can be readily loaded into the logging while drilling tool measurement tool. In addition, each of the micromemories of the present disclosure can be loaded with an amount of 8-KByte data. Hence, a total amount of 8-MByte data can be loaded. Compared with mud pulse transmission, the data transmission system according to the embodiment of the present disclosure can transmit rather a large amount of data to the ground.

In addition, those skilled in the art can, based on the amount of data to be transmitted, increase or decrease the number of the micromemories. The micromemory 43 can also be designed to be larger, so as to manage more communication traffic. Alternatively, a plurality of throw while drilling sections in cascade connection can be used to improve data transmission capacity.

The micromemories can operate either with or without power supply, which will not be limited herein.

Furthermore, as FIG. 3 indicates, the micromemory release mechanism 47 further comprises a drilling fluid flow passage 49, which is configured to communicate with the micromemory storage tank 42 at the second state only, so that the drilling fluid flowing therethrough can enter the micromemory temporary storage 48 to release the micromemory stored therein.

In the embodiment of the present disclosure, the drilling fluid flow passage 49 is formed into a flow pipe having a branch, which communicates with the micromemory temporary storage 48. As shown in FIG. 3, preferably, the drilling fluid flow passage 49 can be formed into a structure having the branch perpendicular to a main pipe, thereby presenting a substantial T shape. Further, the micromemory release mechanism 47 has a 90 degree rotation from the first state to arrive at the second state thereof.

In the embodiment of the present disclosure, the wireless transceiver 63 comprises a measurement while drilling data-writing data line 44 connected to the control circuit 901, and a measurement while drilling data-writing antenna 45 connected to the measurement while drilling data-writing data line 44 and arranged in the micromemory temporary storage 48. The measurement while drilling data-writing antenna 45 can be configured in such a manner that the downhole measurement data are written into only one micromemory stored in the micromemory temporary storage 48 each time. And the measurement while drilling data-writing antenna 45 is arranged in the micromemory storage tank 42 in a region adjacent to the micromemory temporary storage 48.

However, it only provides an example in the above. The wireless transceiver 63 can use other wireless communication modes, such as WiFi, Bluetooth, and ZigBee, to write the downhole measurement data to the micromemories. Such wireless communication modes have a transmission rate a plurality of orders of magnitude higher than mud pulse, electromagnetic, or acoustic transmission, and therefore can guarantee rapid and accurate real-time transmission of the downhole measurement data.

In one embodiment, the same downhole measurement data can be written into a plurality of micromemories 43. As such, where data in a certain micromemory 43 cannot be acquired or processed by the ground receiving device 12, other micromemories that have acquired or loaded with the same data can be referred to, so as to solve the problem of data loss while being transmitted upward.

Besides, as shown in FIG. 2, the power mechanism comprises a motor 511 and a reducer 501. The motor 51 is connected to the control circuit 901, and generate rotating power in accordance with a micromemory release instruction from the control circuit 901. The reducer 501 is connected to the motor 511 in a lower end of the micromemory release mechanism 47, and cooperates with the motor 511, so as to enable the micromemory release mechanism 47 to rotate over a certain degree and convert from the first state to the second state thereof. In the present embodiment, the control circuit 901 can, via a motor control signal line 52, control an action executed by the motor 511. And battery 92 arranged at one side of the control circuit 901 can, via a motor power line 53 and a control circuit power line 91, supply power to the motor 511 and the control circuit 901, respectively.

In one embodiment of the present disclosure, the throw while drilling section 71 further comprises a signal receiving antenna 301 (having seal rings 73 at two end portions thereof) connected to the control circuit 901. The signal receiving antenna can receive micromemory release instructions from the ground, and transmit the micromemory release instructions to the control circuit 901.

Preferably, the signal receiving antenna is in the form of an RFID tag antenna, which can receive micromemory release instructions in an RFID tag from the ground. In one embodiment, of course, a control program can be pre-loaded in the control circuit 901, so that the control circuit 901 can transmit micromemory release instructions periodically.

Figure 5:
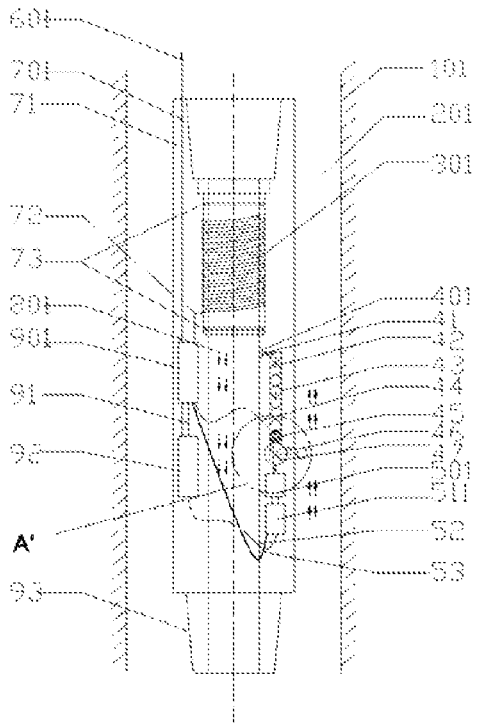
FIG. 5 schematically shows the micromemory release mechanism in a second state according to the embodiment of the present disclosure.
Figure 6:
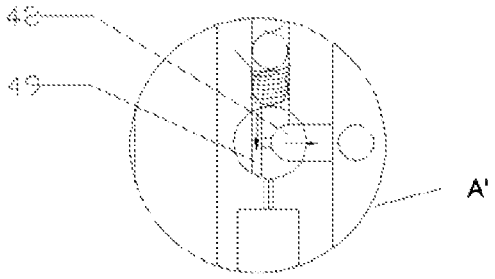
FIG. 6 schematically shows a detail view of region A' as indicated in FIG. 5.

In the following, FIGS. 4-6 will be referred to for explanation of operation of the data transmission system according to this embodiment. It should be noted that, in the present embodiment, the throw while drilling section 71 releases the micromemories one by one. It can be readily understood that, in other embodiments, a predetermined number of micromemories can be released at a time.

In a drilling operation, where the downhole measurement data are necessary to be transmitted to the ground, an operator or a ground throwing device will throw an information tag, such as an RFID tag, down into the well. When the RFID tag passes by the signal receiving antenna 301, the signal receiving antenna 301 will acquire the micromemory release instruction from the RFID tag. After receiving the micromemory release instruction from the signal receiving antenna 301, the control circuit 901 will use the measurement while drilling data-writing data line 44 and the measurement while drilling data-writing antenna 45 to write the measurement while drilling data into the micromemory 43 stored in the micromemory storage tank 42.

Figure 4:
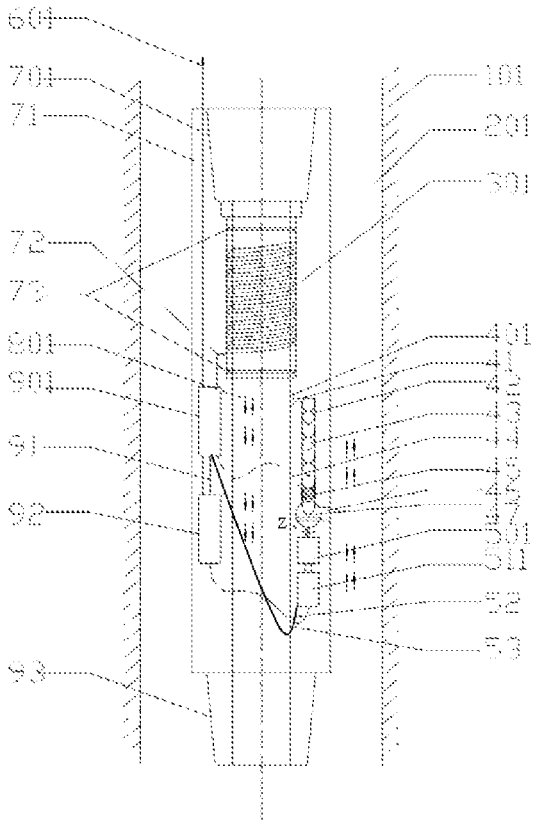
FIG. 4 schematically shows a micromemory release mechanism in a first state according to an embodiment of the present disclosure.

Pressure generated by the drilling fluid flowing through the filter 401 and the capillary drainage tube 41 can be used to push the micromemories stored in the micromemory storage tank 42 downward, so as to push the micromemories 43 loaded with the downhole measurement data into the micromemory temporary storage 48 of the micromemory release mechanism 47 (the first state as indicated in FIG. 4).

Specifically, in the above operation, part of the drilling fluid 801 in the drill string 40 passes through the filter 401 arranged on a side wall of the housing, and flows through the capillary drainage tube 41 connected to the filter 401, so as to generate capillary pressure, which can push the micromemory at a bottom end of the micromemory storage tank 42 into the micromemory temporary storage 48.

Subsequently, the micromemory release mechanism 47, under action of the power mechanism, rotate over a certain degree, so as to align the micromemory temporary storage 48 therein with the micromemory release hole 46.

Specifically, at this stage, the control circuit 901, through control over the motor 511, enables the motor 511 to generate power. The motor 511 and the reducer 501 can cooperate with each other to set the micromemory release mechanism 47 in clockwise rotation over 90 degrees (see arrow z in FIG. 4), so as to align a mouth of the micromemory temporary storage 48 therein with the micromemory release hole 46 (see FIG. 5).

In the end, the drilling fluid 801 in the drill string 40 passes through the filter 401, the capillary drainage tube 411, the micromemory storage tank 42, and the drilling fluid flow passage 49, to enter the micromemory temporary storage 48. A pressure generated thereby can be used to push the micromemory 43 into the annular space 201 through the micromemory release hole 46 (see FIG. 6), such that the micromemory 43 can return to the ground along with slurry circulation.

It should be noted that only slurry is herein used as a carrier of the micromemories 43, and the downhole measurement data are not modulated onto any mud pulse waves. As a result, a data transmission rate can be significantly improved without any additional costs. Besides, the micromemories 43 are released according to a loading sequence of the measured data, thereby ensuring continuous and real-time output of the measurement data.

In the end, the control circuit 901 can control action of the motor 511. The motor 511 and the reducer 501 can cooperate with each other to set the micromemory release mechanism 47 in reverse rotation (counterclockwise rotation) over 90 degrees, so as to get ready for a next release operation of the micromemory.

To conclude the above, according to the data transmission system for transmission of downhole measurement while drilling data to the ground in the embodiment of the present disclosure, the throw while drilling section connected to the logging while drilling measurement tool can be used to release the micromemory loaded with the downhole measurement data to the ground, thereby achieving transmission of the downhole measurement data to the ground. Such a data transmission system can significantly improve data transmission rates and communication reliability. Moreover, since only slurry is used as a transmission medium of the micromemory, no additional costs will be incurred, nor will the normal drilling operation be affected.

Embodiment 2

Figure 7:
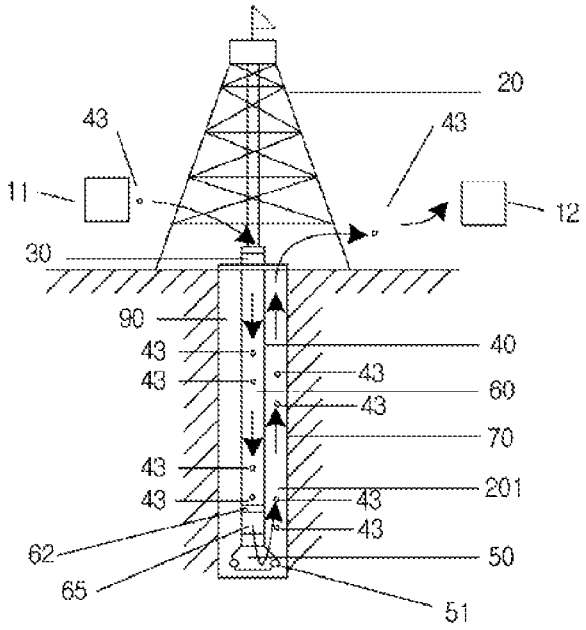
FIG. 7 schematically shows a data transmission system used for transmitting downhole measurement while drilling data to the ground according to another embodiment of the present disclosure.

FIG. 7 schematically shows a data transmission system used for transmitting downhole measurement while drilling data to the ground according to another embodiment of the present disclosure.

The data transmission system comprises a drill string 40, which is connected to a drilling derrick 20 set up on ground, and mounted with a logging while drilling measurement tool 65; a housing which is mounted outside of the drill string 40 as a sleeve to form a clearance space therebetween; a control circuit, which is arranged in the clearance space, and used for receiving and transmitting the downhole measurement data measured by the logging while drilling measurement tool 65; a wireless transceiver 62, which is electrically connected to the control circuit, and used for writing the downhole measurement data received by the control circuit into a micromemory 43 which passes by the wireless transceiver 62; and a ground throwing device 11, which is used for throwing the micromemory from the ground into the drill string 40.

The drill string 40 includes a longitudinal fluid passage 60, which is, through an outlet thereof, communicating with a water hole 51 of a drill 50. A drilling fluid flows through the longitudinal fluid passage 60, and is used for lubricating the drill 50 and washing drilling cuttings from the water hole 51. An annular space 201 is formed between the drill string 40 and a borehole wall 70. The micromemory 43, loaded with the downhole measurement data, is configured to be capable of passing, under the action of the drilling fluid flowing in the longitudinal fluid passage 60, through the water hole 51 of the drill 50 connected to the drill string 40, and then being released to the ground through the annular space 20.

In the following, it will be explained in detail how the system will be used to transmit the downhole measurement data to the ground.

The control circuit connected to the logging while drilling measurement tool 65 can, via a wire transmission mode, acquire the downhole measurement data measured by the logging while drilling measurement tool 65. And the ground throwing device 11 will throw the micromemory 43 from the ground into the fluid passage 60 of the drill string 40. In one embodiment, the ground throwing device 11 can periodically throw the micromemory 43 from the ground into the fluid passage 60 of the drill string 40, wherein in order to ensure continuous data transmission, at least one micromemory 43 can be used.

When the micromemory 43 passes by the wireless transceiver 62, the wireless transceiver 62 will, through a wireless communication mode, write the downhole measure data in the control circuit into the micromemory 43.

It should be noted that, the micromemory 43, besides being written the downhole measurement data thereinto when passing by the wireless transceiver 62, can also transmit a control instruction from the ground to the control circuit via the wireless transceiver 62. Specifically, before being thrown into the fluid passage 60 of the drill string 40, the micromemory 43 can be loaded with a ground control instruction. When the micromemory 43 loaded with the ground control instruction passes by the wireless transceiver 62, the wireless transceiver 62 will, via a wireless transmission mode, transmit the control instruction into the control circuit connected to the wireless transceiver 62. Subsequently, the control circuit will transmit the ground control instruction as acquired into the logging while drilling measurement tool 65. This can ensure prompt transmission of the ground control instruction down into the well for guidance of well drilling, thus achieving data interaction between the ground and the underground during well drilling.

The above short-distance wireless transmission modes preferably comprise wireless transmission protocols of WiFi, Bluetooth, ZigBee, and RFID. Such commonly used short-distance wireless communication modes can have a transmission rate higher than 100 Kbits/s, which is a plurality of orders of magnitude higher than mud pulse, electromagnetic, or acoustic transmission, and therefore can significantly improve data transmission rates.

In the embodiment of the present disclosure, the micromemory 43 can comprise a transceiver circuit and a memory circuit. Preferably, the micromemory can load an amount of data in the range from 1 bit to 100 megabits.

In addition, it should be noted that, so along as the duration of data transmission between the micromemory 43 and the wireless transceiver 62 down in the well reaches 1 s, the effect thereof can be an equivalent of 10 Ks (about three hours) of mud pulse transmission. If the mud pulse transmission is performed in a continuous throwing mode at one-minute intervals, the data transmission efficiency of the wireless transceiver 62 will be dozens or even hundreds of times that of mud pulse transmission. Moreover, the wireless transmission mode will impose very slight influences on a normal fluid drilling operation, and can therefore ensure fast and accurate real-time transmission of the downhole data.

Subsequently, the micromemory 43 loaded with the downhole measurement data will migrate with the drilling fluid in the fluid passage 60 of the drill string 40, pass through the drill string 40 from the water hole 51 of the drill 50, enter the annular space formed between the drill string 40 and the borehole wall 70, and finally return to the ground through rotation along with circulation of slurry.

Because it is necessary for the micromemory 43 to pass through the drill string 40 via the water hole 51, preferably, the micromemory 43 is formed into a sphere or a cylinder having a diameter in the range from 5 to 20 mm, and a thickness in the range from 0.1 to 20 mm.

In the present embodiment, a technology of system in a package is used to integrate all circuits necessary for the micromemory 43 into one package, thereby achieving 7 mm diameter packaging. The micromemory 43 thus designed can have a sufficiently small volume for it to pass through the water hole 51 of the drill 50 completely, and the packaging technology thereof can bear high pressure and high temperature downhole environment also. In addition, the micromemory 43 can operate either with or without power supply, which will not be limited herein.

Only slurry is herein used as a carrier of the micromemory 43, while the downhole measurement data are not modulated onto mud pulse waves. As a result, the data transmission rate can be significantly improved. In addition, the ground throwing device 11 will periodically throw the micromemory 43 down, thereby ensuring continuous and real-time outputs of the downhole measurement data.

In the end, the ground receiving device 12 will communicate with the micromemory 43 that has been returned to the ground, and receive and process the downhole measurement data loaded therein.

To conclude the above, with the data transmission system for transmission of downhole measurement while drilling data to the ground according to the embodiment of the present disclosure, data transmission rates and communication reliability during transmission of downhole measurement data to the ground can be largely improved. Moreover, since only slurry is used as a transmission medium of the micromemory, no additional costs will be incurred, nor will the normal drilling operation be affected.

The above description should not be construed as limitations of the present disclosure, but merely as exemplifications of preferred embodiments thereof. Any variations or replacements that can be readily envisioned by those skilled in the art are intended to be within the scope of the present disclosure. Hence, the scope of the present disclosure should be subject to the scope defined in the claims.

The invention claimed is:

1. A data transmission system for transmission of downhole measurement while drilling data to ground, comprising:

a drill string mounted with a logging while drilling measurement tool, and a throw while drilling section, which is provided on the drill string and accommodates a micromemory, the throw while drilling section including a housing which is mounted outside of the drill string as a sleeve to form a clearance space therebetween; a control circuit provided in the clearance space, configured for receiving and transmitting downhole measurement data measured by the logging while drilling measurement tool; and a wireless transceiver connected to the control circuit, configured for writing the downhole measurement data received by the control circuit into the micromemory, wherein the throw while drilling section releases, under function of a micromemory release instruction transmitted by the control circuit, the micromemory loaded with the downhole measurement data to the ground, wherein the housing of the throw while drilling section is provided with a micromemory release hole on a side wall thereof, and the micromemory loaded with the downhole measurement data is, via the micromemory release hole, released into an annular space formed between the drill string and a borehole wall, so that the micromemory is returned to the ground along with circulation of slurry, wherein the throw while drilling section further comprises:

a power mechanism which is connected to the control circuit and controlled under function of the micromemory release instruction transmitted by the control circuit; and a micromemory release mechanism, wherein the micromemory release mechanism comprises a micromemory temporary storage, which, at a first state of the micromemory release mechanism, temporarily stores the micromemory loaded with the downhole measurement data, and at a second state of the micromemory release mechanism, rotates under action of the power mechanism, so that the micromemory loaded with the downhole measurement data is released into the annular space via the micromemory release hole.

2. The data transmission system according to claim 1, wherein the throw while drilling section further comprises a micromemory storage tank arranged in the clearance space, the micromemory storage tank having an upper end communicating with the drill string, and a lower end communicating with the micromemory temporary storage, so that the micromemory accommodated in the micromemory storage tank can enter the micromemory temporary storage under action of a drilling fluid from the drill string.

3. The data transmission system according to claim 2, wherein the wireless transceiver comprises a measurement while drilling data-writing data line connected to the control circuit, and a measurement while drilling data-writing antenna connected to the measurement while drilling data-writing data line and arranged in the micromemory storage tank, and wherein the measurement while drilling data-writing antenna is configured in such a manner that the downhole measurement data are written into only one micromemory stored in the micromemory storage tank each time.

4. The data transmission system according to claim 3, wherein the measurement while drilling data-writing antenna is arranged in the micromemory storage tank at a region adjacent to the micromemory temporary storage.

5. The data transmission system according to claim 1, wherein the power mechanism comprises a motor and a reducer.

6. The data transmission system according to claim 2, wherein the micromemory release mechanism further comprises a drilling fluid flow passage, which is configured to communicate with the micromemory storage tank at the second state thereof only, so that the drilling fluid flowing therethrough can enter the micromemory temporary storage, and release the micromemory stored therein.

7. The data transmission system according to claim 6, wherein the drilling fluid flow passage is formed into a flow pipe having a branch, which communicates with the micromemory temporary storage.

8. The data transmission system according to claim 6, wherein the micromemory release mechanism turns from the first state to the second state through a 90 degree rotation.

9. The data transmission system according to claim 1, wherein the control circuit transmits micromemory release instructions periodically.

10. The data transmission system according to claim 1, wherein the throw while drilling section further comprises a signal receiving antenna connected to the control circuit, the signal receiving antenna receiving micromemory release instructions from the ground, and transmitting the micromemory release instructions to the control circuit.

11. The data transmission system according to claim 10, wherein the signal receiving antenna is in the form of an RFID tag antenna, which receives micromemory release instructions in RFID tags from the ground.

12. The data transmission system according to claim 1, further comprising a ground receiving device, which receives and processes the downhole measurement data stored in the micromemory.

13. The data transmission system according to claim 1, wherein the micromemory is formed into a sphere or a cylinder having a diameter in the range from 5 to 50 mm, and a thickness in the range from 0.1 to 50 mm.

14. The data transmission system according to claim 1, wherein the micromemory can load an amount of data in the range from 1 bit to 100 megabits.

15. A method for transmitting downhole measurement data with the data transmission system according to claim 1, comprising:

putting a plurality of micromemories into the throw while drilling section;

receiving and transmitting, via the control circuit, the downhole measurement data measured by the logging while drilling measurement tool;

writing, by the wireless transceiver, the downhole measurement data of the control circuit into the micromemories; and releasing, by the throw while drilling section, the micromemories loaded with the downhole measurement data to the ground, under function of the micromemory release instructions transmitted by the control circuit.

* * * * *